United States Patent [19]

Rudick

[11] Patent Number: 4,753,370

[45] Date of Patent: Jun. 28, 1988

[54] TRI-MIX SUGAR BASED DISPENSING SYSTEM

[75] Inventor: Arthur G. Rudick, Marietta, Ga.

[73] Assignee: The Coca-Cola Company, Atlanta, Ga.

[21] Appl. No.: 24,477

[22] Filed: Mar. 11, 1987

Related U.S. Application Data

[63] Continuation-in-part of Ser. No. 842,287, Mar. 21, 1986, Pat. No. 4,708,266.

[51] Int. Cl.[4] ..... B65D 35/36

[52] U.S. Cl. ..... 222/105; 239/406; 222/129.1; 222/132; 222/144.5; 222/214; 222/459; 222/325

[58] Field of Search ..... 222/105, 129.1, 135, 222/132, 144.5, 214, 459, 325; 239/406; 417/474–477

[56] References Cited

U.S. PATENT DOCUMENTS

| | | | |
|---|---|---|---|
| 2,462,019 | 2/1949 | Bowman | 222/136 |
| 2,831,610 | 4/1958 | Dennie | 222/183 |
| 3,106,895 | 10/1963 | Hood . | |
| 3,323,681 | 6/1967 | Di Vette et al. | 222/129.1 |
| 3,831,854 | 8/1974 | Sato et al. | 239/406 |
| 4,135,647 | 1/1979 | Mascia et al. | 222/325 |
| 4,266,726 | 5/1981 | Brown et al. | 222/129.1 |
| 4,290,558 | 9/1981 | Coburn et al. | 239/406 |
| 4,600,151 | 7/1986 | Bradley | 239/406 |

*Primary Examiner*—H. Grant Skaggs

*Attorney, Agent, or Firm*—Birch, Stewart, Kolasch & Birch

[57] ABSTRACT

A tri-mix beverage dispensing system includes an unsweetened flavor concentrate assembly, a sweetener syrup assembly, and a diluent assembly, such as for carbonated water. These ingredients are mixed together to form a post-mix beverage. Mixing occurs outboard of a nozzle structure. Consequently, a common nozzle may be utilized for mixing a wide variety of beverage flavors without flavor carry-over in the nozzle.

8 Claims, 4 Drawing Sheets

TRI-MIX SUGAR BASED DISPENSING SYSTEM

BACKGROUND OF THE INVENTION

This application is a continuation-in-part of U.S. Ser. No. 842,287, filed Mar. 21, 1986, now U.S. Pat. No. 4,708,266.

The present invention relates to a tri-mix beverage dispensing system wherein unsweetened flavor concentrate, sweetener syrup and a diluent, such as carbonated water, are mixed together to form a post-mix beverage. More specifically, the present invention relates to such a dispenser wherein a large number of different flavor concentrates may be selectively dispensed through a common nozzle to create a wide variety of beverage flavors without flavor carry-over in the nozzle.

In the contemporary carbonated beverage market, there is increasing demand for a large number of beverage flavors and products. For example, in addition to the traditional cola brands containing syrup and caffein, there is a demand for artificially sweetened drinks, and also caffein-free drinks. The beverage industry has responded to this demand by providing a large variety of pre-mix, packaged products to satisfy the consumer's tastes.

However, in the post-mix or fountain beverage market, it has been difficult to provide the full range of available flavors and products commensurate with the range of packaged products available. This is primarily due to the nature of the post-mix dispensing equipment now utilized in the industry. These conventional dispensers are bi-mix systems which mix sweetened flavor concentrate (syrup) and a diluent, such as carbonated water, together to form a post-mix beverage. Generally speaking, these dispensers have one dispenser nozzle and associated valve for each flavor of beverage to be dispensed. Consequently, the number of beverage choices for a given dispenser is limited by the number of nozzles available, especially since the use of the same nozzle for different flavors is likely to result in flavor carry-over from beverage to beverage.

SUMMARY OF THE INVENTION

Accordingly, it is a primary object of the present invention to provide a post-mix beverage dispenser for making a maximum number of beverage flavors utilizing a minimum number of valve and nozzle assemblies.

It is a further object of the present invention to provide a post-mix beverage dispenser system wherein a given nozzle and valve assembly may be successively used for dispensing beverages of different flavors without flavor carry-over between beverages.

It is another object of the present invention to provide a tri-mix post-mix beverage dispenser system which mixes unsweetened flavor concentrate, sweetener syrup and a diluent, such as carbonated water together, whereby only one type of syrup is needed for all beverages, making bulk syrup delivery possible to smaller outlets.

The objects of the present invention are fulfilled by providing in a post-mix beverage dispenser including a water supply assembly, a concentrate supply assembly, a sweetener syrup supply assembly, and a mixing assembly for mixing water from the water supply assembly and concentrate from the concentrate supply assembly together to form the post-mix beverage, the improvement comprising:

(a) peristaltic pump means having a rotary pumping member;

(b) the concentrate supply assembly being disposable and including, 1. a disposable concentrate container; and
2. disposable flexible conduit means connecting said concentrate container to said mixing assembly and being disposed in operative engagement with said rotary pump member to cause concentrate in the container to be pumped through the conduit means to the mixing assembly and;

(c) nozzle means within the mixing assembly coupled to the water supply assembly and the sweetener syrup supply assembly for directing the water to an isolated mixing area out of contact with any surfaces of the dispenser, said nozzle means including, 1. a housing having an input end for the water, sweetener syrup and concentrate, and a discharge opening at an output end thereof, said housing having an axial bore extending from the input end to the discharge opening,
2. a first toroidal chamber at said input end of the housing having an inlet conduit for said water tangentially disposed with respect thereto to create a swirling of the water in said chamber,
3. a second toroidal chamber at the input end of said housing concentric with said second toroidal chamber having a syrup inlet conduit for receiving sweetener syrup from said sweetener supply assembly,
4. an annular chamber disposed inboard of said first toroidal chamber, and extending from said second toroidal chamber toward said discharge opening, for directing the sweetener syrup into contact with said water inboard of walls of said axial bore,
5. means for directing said water from said first toroidal chamber through the housing concentrically about the axial bore and out of said discharge opening to convergence at the isolated area outboard of the nozzle, and
6. means for directing a stream of the concentrate from the input end along the longitudinal axis of the housing through said axial bore to said mixing area, the diameter of the stream being less than the diameter of the axial bore to preclude the concentrate from contacting any surfaces of the nozzle housing;

whereby the water, sweetener syrup and concentrate are mixed together to form a post-mix beverage and the concentrate is precluded from contacting any portions of the water supply or mixing assemblies of the dispenser.

BRIEF DESCRIPTION OF THE DRAWINGS

The objects of the present invention and the attendant advantages thereof will become more readily apparent by reference to the drawings, like reference numerals referring to like parts, and wherein:

FIG. 2A is a top plan view of the nozzle of FIG. 2;

FIG. 2B is a cross-sectional view taken along lines 2B—2B of FIG. 2;

FIG. 2C is a cross-sectional view taken along lines 2C—2C of FIG. 2;

DETAILED DESCRIPTION OF THE DRAWINGS

Figure 1:
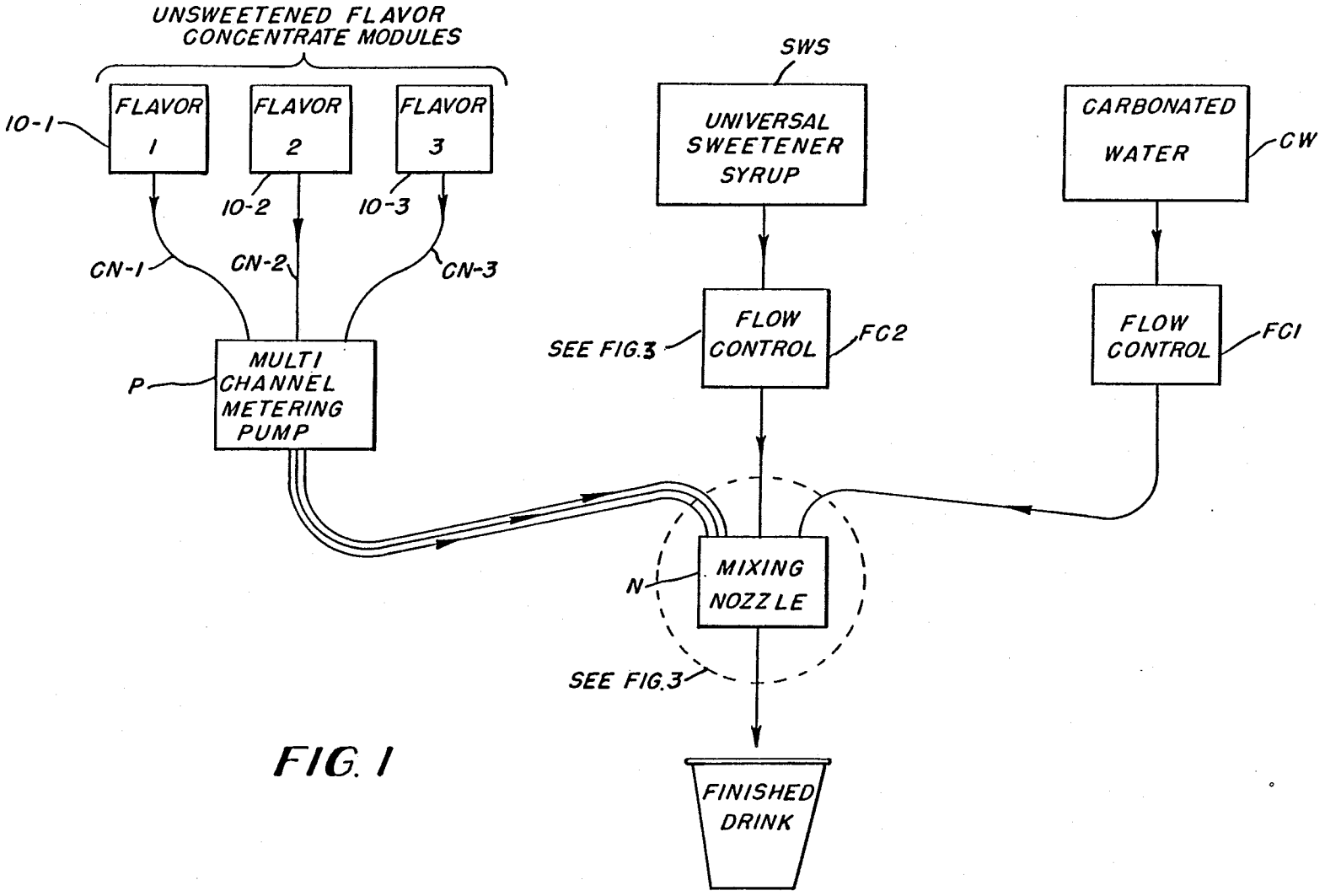
FIG. 1 is a schematic block diagram of a tri-mix post-mix dispensing system of the present invention.

In FIG. 1 of parent application Ser. No. 842,287, filed Mar. 21, 1986, there is illustrated a post-mix beverage dispensing system for making a post-mix beverage of a selected single flavor, including a concentrate reservoir 10 coupled through a valve V to a flexible concentrate conduit CN. The flexible concentrate conduit is operatively associated with a peristaltic pump P. The flexible concentrate conduit CN extends to a mixing nozzle N to supply concentrate to an isolated mixing area. Also illustrated in FIG. 1 of the aforementioned parent application is a conventional water supply assembly for transporting carbonated water to the nozzle N. It may include, for example, a $CO_2$ bottle CB coupled through a pressure regulator R, which leads to a carbonator tank CT. Water is supplied to the carbonator tank CT from a carbonator pump CP or a commercial water supply, if available. The nozzle N causes the concentrate and carbonated water to be combined together in predetermined proportions for the creation of a post-mix beverage within a serving cup BC.

In FIG. 1 of the present invention, the concentrate supply system is similar to that in Ser. No. 842,286, the details of which are incorporated herein by reference. However, the supply of concentrate includes a plurality of unsweetened flavor concentrate modules 10-1, 10-2, 10-3 for selectively supplying one of three concentrate flavors to nozzle N through a multi-channel metering pump P. Pump P, and the manner in which it pumps selected flavor concentrates to nozzle N will be described hereinafter with respect to FIG. 5. It should be understood that even though only three flavor concentrate modules are illustrated in FIG. 1 that more or less may be provided as desired.

The carbonated water supply system of FIG. 1 of the present invention includes a source of carbonated water CW and a flow controller FC1 therefor for supplying carbonated water at a controlled rate of flow to nozzle N.

In accordance with the novel aspects of the present invention, a source of universal sugar/water syrup (sweetener) is provided in fluid communication with nozzle N. Accordingly, FIG. 1 illustrates a preferred tri-mix system in which unsweetened flavor concentrate, sweetener syrup and carbonated water are mixed by nozzle N to form a post-mix carbonated beverage. The flow control FC2 of FIG. 1 will be described hereinafter with reference to FIG. 3.

Figure 5:
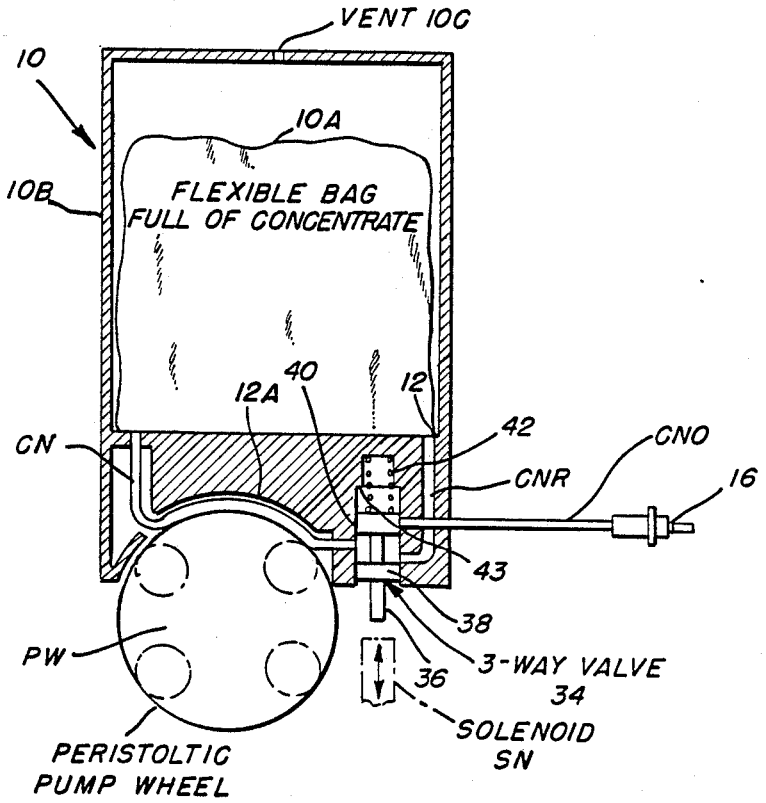
FIG. 5 is a side elevation partially in cross-section, illustrating a concentrate dispenser of the present invention and an associated three-way valve to be utilized in the multi-flavor post-mix beverage dispensing system of FIG. 4.

FIG. 5 illustrates the interaction of the peristaltic pump P and the flexible concentrate supply conduits CN-1, CN-2, CN-3 in the concentrate dispensing assembly of the present invention. As illustrated in FIG. 5, each of the concentrate containers 10-1, 10-2, 10-3 may include a rigid outer shell 10B and an inner collapsible bag 10A. Rigid outer shell 10B is also provided with a vent 10C. The collapsible bag 10A contains the unsweetened flavor concentrate to be dispensed and may be sealed to the periphery of the bottom 12 of container 10 so that the concentrate therein is in fluid communication with a flexible conduit CN. The flexible conduits CN-1, CN-2, CN-3 have a first end secured to the rigid shell 10-B and a second end secured to valve 34. The flexible conduits CNO-1, CNO-2, CNO-3 have a first end secured to the valve 34 and a second end secured to an injector 16 to be snapped into the nozzle structure of FIG. 2, to be discussed hereinafter. As illustrated in FIG. 5, conduit CN passes over a curved surface 12A in the bottom of container 10 into operative engagement with the periphery of peristaltic pump wheel PW when container 10 is inserted into the dispenser. Accordingly, as peristaltic pump wheel PW rotates, the flexible conduits CN-1, CN-2, CN-3 are pinched against the curved surface 12A to positively displace and pump concentrate through the conduit to the injector 16. As illustrated in FIG. 5, surface 12A in the bottom of the container 10 has a complementary shape to the exterior or peripheral surface of the peristaltic pump PW. The manner in which a selected concentrate 10-1, 10-2, or 10-3 is delivered to nozzle N will be discussed hereinafter with reference to FIG. 4.

Figure 2:
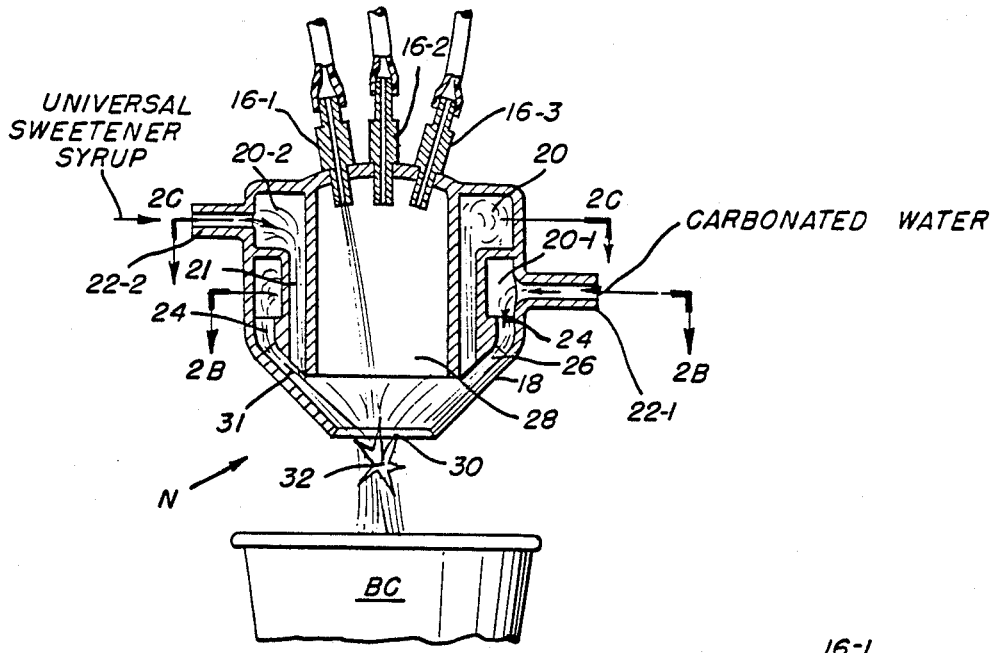
FIG. 2 and related
Figure 2A:
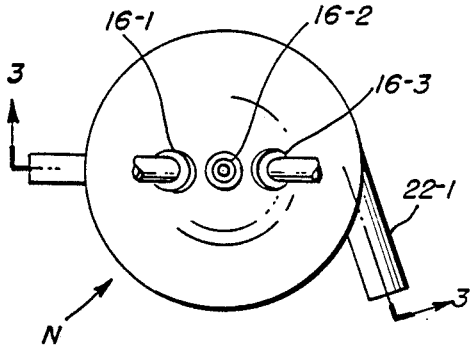
FIGS. 2A to 2C illustrate the mixing nozzle assembly of the present invention.
Figure 2B:
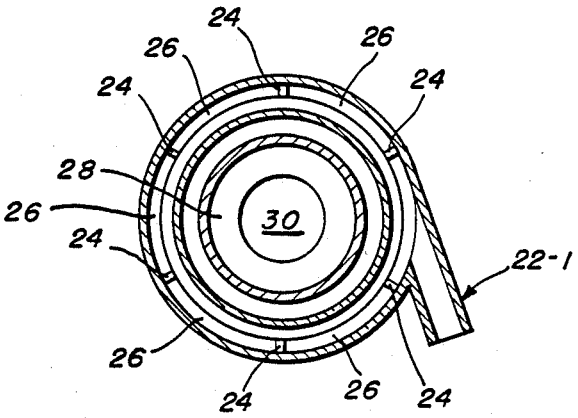
Figure 2C:
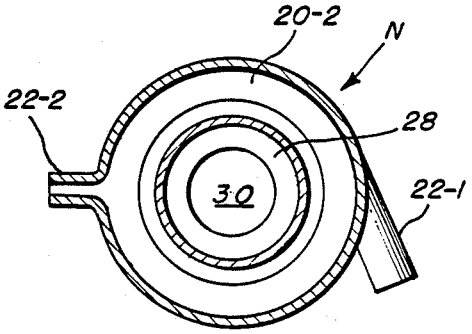

Referring to FIG. 2, and associated FIGS. 2A to 2C, there is illustrated the mixing assembly and nozzle structure of the present invention, suitable for use in the tri-mix system of FIG. 1. As illustrated in these Figures, the nozzle includes a frusto-conical housing 18, including an input end with a first toroidal plenum 20-1, which surrounds an axial bore 28 extending through the nozzle structure. A second toroidal plenum 20-2 is disposed above and concentric with plenum 20-1. Still water or carbonated water, such as from the carbonated water supply assembly CW of FIG. 1, is introduced through a tangentially disposed conduit 22-1 into the plenum 20 to create a swirling action of the water. The water then passes down through passages 26 defined between radial partitions 24, and out of the discharge opening 30 of the nozzle to an isolated outboard mixing area 32. Sweetener syrup from SWS is introduced through conduit 22-2 into plenum 20-2 and then into annular chamber 21 (FIG. 2). Meanwhile, as illustrated in FIG. 2, concentrate is supplied through the injectors 16-1, 16-2, 16-3 mounted coaxially with the bore 28 at the input end of the nozzle housing to direct concentrate down the axis of the bore without touching any of the surfaces of the nozzle housing 18 until the concentrate converges at isolated area 32 with the water. The concentrate and water will mix well together at the isolated area 32 just before falling into a beverage serving cup, such as BC of FIG. 1.

Nozzle N is also provided with an annular bore 21 extending from plenum 20-2 toward the nozzle exit, so sweetener syrup in plenum 20-2 mixes with carbonated water at area 31 downstream and inboard of the nozzle walls.

Figure 3:
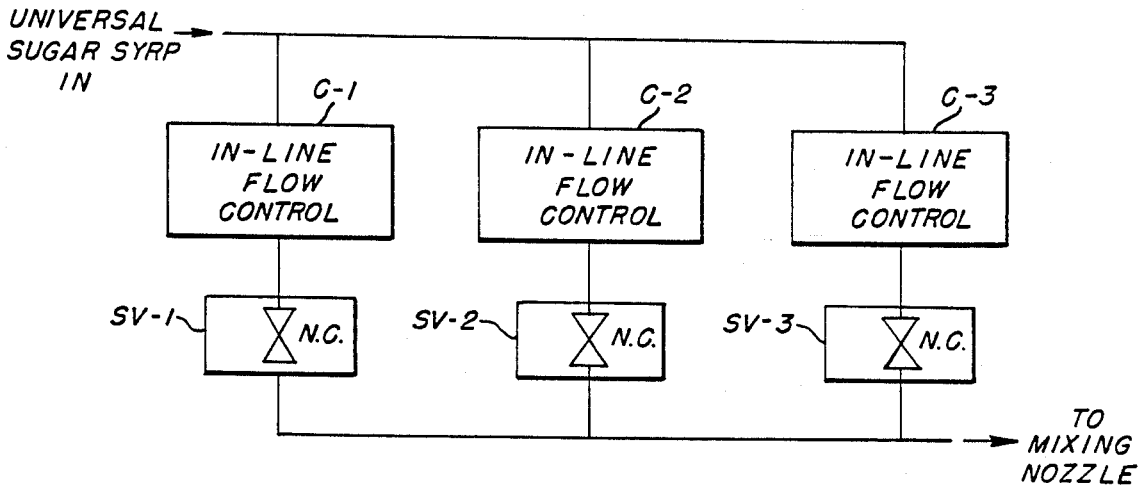
FIG. 3 is a diagrammatic view of the syrup flow control means of FIG. 1.

The nozzle structure of FIG. 3 is particularly advantageous in that neither the concentrate supplied through the flexible conduits CN-1, CN-2, CN-3, nor sweetened syrup touch any of the surfaces of the nozzle housing, and therefore preclude the need for any frequent sanitization of the nozzle housing 18. This also prevents flavor carry-over.

The concentrate assembly illustrated in FIG. 5 is totally disposable with the exception of the peristaltic pump wheel PW and the solenoid SN. Therefore, the sanitization and flavor carry-over problems normally associated with concentrate dispensing systems are eliminated.

Referring to FIG. 3, there is illustrated a possible embodiment of the flow control system FC2 of FIG. 1. Connected between the univeral sugar/water syrup supply (sweetener) SWS and mixing nozzle N is flow controller FC2 shown here with three parallel branches. Each branch has a conventional in-line flow controller, such as C-1, C-2, C-3, and a solenoid valve SV-1, SV-2, SV-3. The in-line flow controllers are set to provide flow rates compatible with the flavor concentrates 10-1, 10-2, 10-3, since different flavors may require different amounts of syrup or sweetener.

Figure 4:
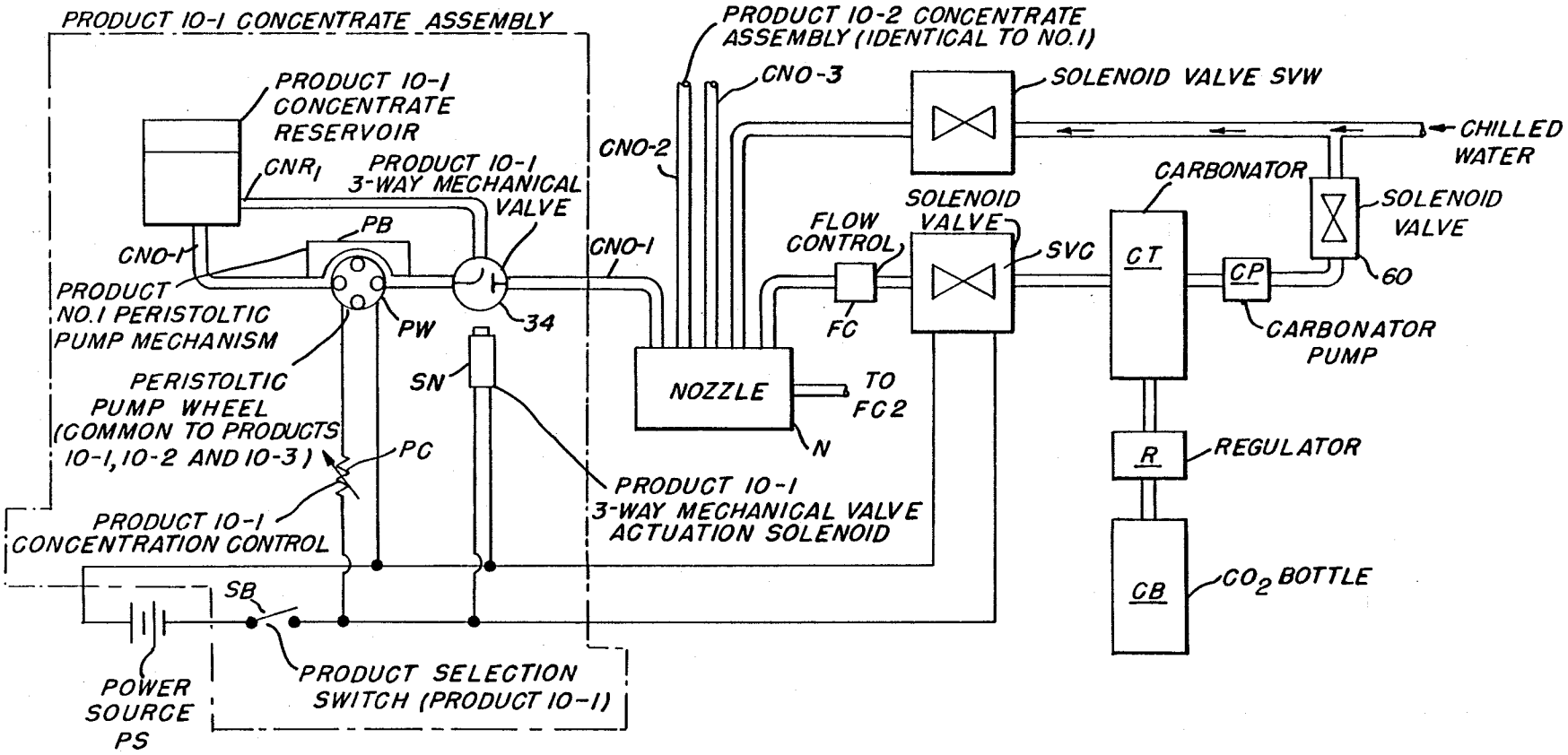
FIG. 4 is a schematic block diagram of a multi-flavor, post-mix beverage dispensing system utilizing the multi-channel metering pump of FIG. 1.

FIG. 4 illustrates in detail the operation of the multichannel metering pump P of FIG. 1 for supplying selected unsweetened flavor concentrate for containers 10-1, 10-2, 10-3 to nozzle N simultaneously with syrup from source SWS.

Referring to FIG. 4, a three-way valve 34 is disposed at the output side of the peristaltic pump wheel in the flexible supply conduit CN-1. The three-way valve has an input port coupled to the flexible conduit CN-1 and two output ports, one of which communicates with concentrate output supply conduit CNO-1 extending to nozzle N, and the other of which is coupled to a concentrate recirculation conduit $CNR_1$, leading to the inside of the collapsible bag 10A in the concentrate container 10. The peristaltic pump wheel PW (see FIG. 5) and the associated motor (not shown) are provided with electrical power from a power source PS upon actuation of a product selection switch SB. Variable resistor PC or any suitable motor speed control device is provided to adjust the speed of the peristaltic pump motor, and therefore the speed of rotation of the peristaltic pump wheel PW to selectively control the amount of concentrate dispensed for a given post-mix beverage during the period that the product selection switch SB is held down. The concentration of the finished drink can thereby be adjusted. It should be noted in the illustration of FIG. 4 that the concentrate supply assembly for only one flavor of concentrate is illustrated in detail for clarity. However, additional, similar concentrate supply assemblies would be provided for the supply of concentrate through the additional flexible conduits CN-2, CN-3, etc., to the nozzle N.

An advantage of the multi-flavor system of the present invention is that the concentrate supply assemblies may utilize a common, cylindrical peristaltic pump wheel PW for operatively engaging the respective flexible concentrate supply conduits CN-1, CN-2, CN-3 by virture of the fact that concentrate may be selectively output from any of the concentrate supply assemblies depending on the condition of the three-way solenoid actuated valves 34.

The operation of three-way valves 34 may be best understood by reference to FIG. 5. As illustrated in FIG. 5, the three-way valves 34 may have a pair of valve elements 38, 40 mounted on a common stem 36 in operative association with an input port coupled to flexible conduit CN and output conduits coupled to flexible conduits CNO and CNR, respectively. As illustrated in FIG. 5, when the valve is in the position shown, and peristaltic pump wheel PW is rotating, concentrate is positively displaced through flexible conduit CN into the input port of valve 34 and out the output port coupled to recirculation conduit CNR into the interior of flexible bag 10A. When the valve is in this position, concentrate will merely recirculate in a closed loop, and no concentrate will be dispensed through flexible conduit CNO to the concentrate injector structure 16. However, when the three-way valve 34 is actuated to depress stem 36 upwardly, against the force of spring 42 until valve element 40 seats against step 43, the valve element 38 will close the output port leading to the recirculation conduit CNR and valve element 40 will open the valve outlet port leading to the concentrate output conduit CNO. Accordingly, in this position, concentrate will flow to the injector 16. Accordingly, a single peristaltic pump and associated cylindrical wheel PW may be utilized with a plurality of respective flexible conduits leading to concentrate containers of diel PW may be utilized with a plurality of respective flexible conduits leading to concentrate containers of different flavors and selective dispensing of the concentrate in the respective containers can be affected by actuation of a product selection switch such as SB in FIG. 5 to energize the solenoid-actuated three-way valve 34 in the concentrate dispensing sub-assembly having the desired flavor of the beverage to be dispensed.

Other variations may be made to the system of the present invention as desired. For example, although it is preferable to have the peristaltic pump wheel PW operatively associated with a rigid bottom portion of a concentrate container having a complementary-shaped exterior surface, the curved surface may be provided on a separate block such as PB illustrated in Figure 5. Also, the water supply assembly may have the capability of supplying either chilled still water or chilled carbonator water, as desired. As illustrated in FIG. 5, chilled still water may be supplied through a solenoid valve SVW to the nozzle N or, in the alternative, chilled carbonator water may be supplied from the carbonator tank CT through a solenoid valve SVC and a flow control valve FC to the nozzle N. The carbonated water system in the illustration of FIG. 4 is supplied to the carbonator tank CT from a $CO_2$ bottle CB and a pressure regulator R.

The tri-mix system of the present invention could also be used for dispensing diet soft-drinks. The artificial sweetener would then be part of the concentrate supply. When a diet product is selected, the artificially sweetened concentrate will mix with carbonated water only at the nozzle. For example, if product 10-2 were DIET COKE, a registered trademark of the The Coca-Cola Company, either in-line flow control C-2 would be shut all the way off, or normally-closed solenoid valve SV-2 would be electrically disconnected so that no sugar syrup flows to the nozzle while product 10-2 is being dispensed.

An alternative use of the present system for making diet drinks is to use artificial sweeteners for the "Sweetener Syrup" of FIG. 1. In this regard, the term "sweetener" can include sugar, corn syrups and artificial dietetic sweeteners or the like.

It should be understood that the system of the present invention may be further modified as would occur to one of ordinary skill in the art without departing from the spirit and scope of the present invention.

What is claimed is:

1. In a post-mix beverage dispenser including a water supply assembly, a sweetener syrup supply assembly, a concentrate supply assembly and a mixing assembly for mixing water from the water supply assembly and concentrate from the concentrate supply assembly together to form the post-mix beverage, the improvement comprising:

(a) peristaltic pump means having a rotary pumping member;

(b) the concentrate supply assembly being disposable and including, 1. a disposable concentrate container; and
2. disposable flexible conduit means connecting said concentrate container to said mixing assembly and being disposed in operative engagement with said rotary pump member to cause concentrate in the container to be pumped through the conduit means to the mixing assembly; and (c) nozzle means within the mixing assembly coupled to the water supply assembly and the sweetener syrup supply assembly for directing the water to an isolated mixing area out of contact with any surfaces of the dispenser, said nozzle means including, 1. a housing having an input end for receiving the water, sweetener syrup and concentrate, and a discharge opening at an output end thereof, said housing having an axial bore extending from the input end to the discharge opening,
2. a first toroidal chamber at said input end of the housing having an inlet conduit for said water tangentially disposed with respect thereto to create a swirling of the water in said chamber,
3. a second toroidal chamber at the input end of said housing concentric with said second toroidal chamber having a syrup inlet conduit for receiving sweetener syrup from said sweetener syrup supply assembly,
4. an annular chamber disposed inboard of said first torodial chamber, and extending from said second toroidal chamber toward said discharge opening, for directing the sweetener syrup into contact with said water inboard of walls of said axial bore,
5. means for directing said water from said first toroidal chamber through the housing concentrically about the axial bore and out of said charge opening to convergence at the isolated area outboard of the nozzle, and
6. means for directing a stream of the concentrate from the input end along the longitudinal axis of the housing through said axial bore to said mixing area, the diameter of the stream being less than the diameter of the axial bore to preclude the concentrate from contacting any surfaces of the nozzle housing;

whereby the water, sweetener syrup and concentrate are mixed together to form a post-mix beverage and the concentrate is precluded from contacting any portions of the water supply or mixing assemblies of the dispenser.

2. The dispenser of claim 1 wherein the concentrate container has an external surface portion with a complementary shape to an external surface of the rotary member of the peristaltic pump, and the conduit means is operatively engaged between said surface portion and said external surface.

3. The dispenser of claim 2 wherein said rotary pumping member has a circular external surface.

4. The dispenser of claim 2 wherein said container includes a rigid outer shell, a portion of which forms said surface portion, and a sealed collapsible bag within said rigid outer shell, said bag having a discharge opening in fluid communication with said conduit means through a valve means.

5. The dispenser of claim 1 wherein there are provided a plurality of concentrate supply assemblies, each of said assemblies supplying different flavor concentrates.

6. The dispenser of claim 5 wherein said sweetener syrup supply assembly further includes flow rate control means for selecting rates of syrup flow to said nozzle compatible with the type of flavor concentrate being supplied thereto.

7. In a post-mix beverage dispenser including a water supply assembly, a sweetener syrup supply assembly, a concentrate supply assembly and a mixing assembly for mixing water from the water supply assembly and concentrate from the concentrate supply assembly together to form the post-mix beverage, the improvement comprising:

(a) concentrate supply means for selectively supplying one of a plurality of concentrate flavors;

(b) pump means for supplying metered quantities of the selected flavor concentrate to the nozzle means recited hereinafter; and (c) nozzle means within the mixing assembly coupled to the water supply assembly and the sweetener syrup supply assembly for directing the water to an isolated mixing area out of contact with any surfaces of the dispenser, said nozzle means including, 1. a housing having an input end for the water, sweetener syrup and concentrate, and a discharge opening at an output end thereof, said housing having an axial bore extending from the input end to the discharge opening;
2. a first toroidal chamber at said input end of the housing having an inlet conduit for said water tangentially disposed with respect thereto to create a swirling of the water in said chamber;
3. a second toroidal chamber at the input end of said housing concentric with said second toroidal chamber having a syrup inlet conduit for receiving sweetener syrup from said sweetener supply assembly,
4. an annular chamber disposed inboard of said first toroidal chamber, and extending from said second toroidal chamber toward said discharge opening, for directing the sweetener syrup into contact with said water inboard of walls of said axial bore,
5. means for directing said water from said first toroidal chamber through the housing concentrically about the axial bore and out of said charge opening to convergence at the isolated area outboard of the nozzle, and
6. means for directing a stream of the concentrate from the input end along the longitudinal axis of the housing through said axial bore to said mixing area, the diameter of the stream being less than the diameter of the axial bore to preclude the concentrate from contacting any surfaces of the nozzle housing;

whereby the water, sweetener syrup and concentrate are mixed together to form a post-mix beverage and the concentrate is precluded from contacting any portion of the water supply or mixing assemblies of the dispenser.

8. The dispenser of claim 7, wherein said sweetener syrup supply assembly further includes flow rate control means for selecting rates of syrup flow to said nozzle compatible with the type of flavor concentrate being supplied thereto.

* * * * *